US012781644B2

(12) United States Patent
Neu

(10) Patent No.: US 12,781,644 B2
(45) Date of Patent: Nov. 3, 2026

(54) DEVICE FOR ENERGY CONVERSION

(71) Applicant: SEGULA ENGINEERING, Courbevoie (FR)

(72) Inventor: Thibault Neu, Chateau-Thebaud (FR)

(73) Assignee: SEGULA ENGINEERING, Courbevoie (FR)

( * ) Notice: Subject to any disclaimer, the term of this patent is extended or adjusted under 35 U.S.C. 154(b) by 0 days.

(21) Appl. No.: 19/117,909

(22) PCT Filed: Oct. 3, 2023

(86) PCT No.: PCT/EP2023/077295

§ 371 (c)(1),
(2) Date: Apr. 2, 2025

(87) PCT Pub. No.: WO2024/078914

PCT Pub. Date: Apr. 18, 2024

(65) Prior Publication Data

US 2026/0125993 A1 May 7, 2026

(30) Foreign Application Priority Data

Oct. 10, 2022 (FR) ..... 2210358

(51) Int. Cl.
*F01K 27/00* (2006.01)
*F01K 25/06* (2006.01)
(Continued)

(52) U.S. Cl.
CPC ..... *F01K 27/00* (2013.01); *F01K 25/06* (2013.01); *F04B 39/0011* (2013.01); *F04B 53/141* (2013.01); *F04B 53/162* (2013.01)

(58) Field of Classification Search
CPC ..... F01K 27/00; F01K 25/06; F04B 39/0011; F04B 53/141; F04B 53/162
See application file for complete search history.

(56) References Cited

U.S. PATENT DOCUMENTS 5,771,693 A 6/1998 Coney
8,572,959 B2 * 11/2013 Ingersoll ..... F28D 20/0034 60/512

(Continued)

FOREIGN PATENT DOCUMENTS

FR 3036887 A1 12/2016

OTHER PUBLICATIONS

International Search Report and Written Opinion received for PCT/EP2023/077295, mailed Oct. 12, 2023.

(Continued)

*Primary Examiner* — Matthew T Largi
(74) *Attorney, Agent, or Firm* — Greer, Burns & Crain, Ltd

(57) ABSTRACT

A device for isothermal expansion and compression of a gas, ensuring the compression of the gas by consuming mechanical energy and the restitution of the mechanical energy by the expansion of the gas. The device includes at least two liquid pistons movable in at least two chambers each including a gas that is able to be compressed or expanded by movement of the liquid pistons. A mechanical actuator, including at least one solid piston, ensures the movement of the liquid pistons in the chambers. Each chamber includes an insert, through which the liquid and the gas can circulate, the insert including through-cells, which extend in a direction parallel to the direction of movement of the liquid piston in the insert. The device includes at least one first phase separator connected to an outlet of each of the chambers, and to a tank for storing pressurized gas.

19 Claims, 3 Drawing Sheets

(51) Int. Cl.

| | |
|---|---|
| ***F04B 39/00*** | (2006.01) |
| *F04B 53/14* | (2006.01) |
| *F04B 53/16* | (2006.01) |

(56) References Cited

U.S. PATENT DOCUMENTS

| | | | | |
|---|---|---|---|---|
| 9,234,480 | B2 * | 1/2016 | Gayton | F28F 1/022 |
| 9,234,534 | B2 * | 1/2016 | Cyphelly | F15B 15/00 |
| 2008/0264062 | A1 * | 10/2008 | Prueitt | F01K 27/00 60/671 |
| 2010/0329903 | A1 * | 12/2010 | Fong | F01B 17/022 137/12 |
| 2015/0110647 | A1 * | 4/2015 | Wilhelm | F04B 39/0005 417/228 |
| 2017/0002803 | A1 * | 1/2017 | Van de Ven | F04B 39/0011 |
| 2018/0100385 | A1 * | 4/2018 | Elmer | E21B 43/168 |
| 2018/0142681 | A1 * | 5/2018 | Crowley | F02G 1/043 |
| 2024/0344508 | A1 * | 10/2024 | Rabhi | F04B 39/0011 |

OTHER PUBLICATIONS

Search Report received for French Application No. 2210358, dated Jun. 1, 2023.

* cited by examiner

DEVICE FOR ENERGY CONVERSION

BACKGROUND

The invention concerns a system for energy conversion and storage.

In the literature, gas compression and/or expansion by means of a liquid piston appears to be a promising solution for increasing the energy efficiency of power generation plants, with the aim of achieving the most isothermal thermodynamic evolution possible.

Technologies are known, such as those described in patent application FR 3036887, which use pumps or turbines to achieve energy conversion between a mechanical actuator and the liquid in the liquid piston. One or more liquid piston compression stages are implemented in such systems to traverse the desired gas pressure range.

Various installations or devices can be deployed to increase heat exchange in the liquid piston compression chamber, such as spraying water droplets, running multiple chambers in parallel, adding a heat exchange insert, etc.

These installations give rise to a number of problems: in particular, to achieve near-isothermal compression/expansion, a significant heat exchange is required in the expansion and/or compression chambers, the value of which is several orders of magnitude greater than the exchanges existing in conventional technologies.

The installations proposed in patent application FR 3036887 have lengthened compression/expansion times, but use simple technical solutions to achieve near-isothermal operation. As a result, however, the plants are quite large, taking up a lot of space (around 50,000 m3 for a 15 MW power plant), which can lead to high operating costs.

Other technologies offer more compact solutions, but are more complex to implement, which means that operating costs cannot be reduced.

Thus, the level of complexity and the cost of such installations are obstacles to the development of such technologies.

SUMMARY

The invention offers an alternative solution that is simple to implement and can be sized to suit the applications for which it will be specifically designed.

To this end, the invention relates to a device for the isothermal expansion and compression of a gas, ensuring the compression of said gas by consuming mechanical energy and the restitution of the mechanical energy by the expansion of said gas, said device comprising:

- at least one first and at least one second liquid piston, movable respectively in a first and a second chamber, each of said at least one first and second chambers comprising a gas that is able to be compressed or expanded by movement of said at least one first or second liquid piston,
- an actuator, capable of moving said at least first and second liquid pistons in said first and second chambers, each of said at least one first and second chambers respectively comprising at least one first and at least one second apertured insert, through which said liquid and said gas can flow.

The device according to the invention is remarkable in that the actuator is a mechanical actuator comprising at least one solid piston, in that said apertured insert comprises through-cells which extend between a first cell aperture opening out at one end of said insert and a second cell aperture opening out at a second end of said insert, said cells being oriented in a direction which is either parallel to the direction of movement of said liquid piston in said insert or inclined with respect to the direction of movement of said liquid piston. Finally, said device further comprises at least a first phase separator connected to a first outlet of said first chamber and to a second outlet of said second chamber.

Advantageously, the phase separator is connected to a pressurized gas storage tank.

According to an advantageous embodiment, the device according to the invention comprises a second separator, connected to said first and second outlets of said first and second chambers, respectively, in that said first separator comprises a first internal pressure which corresponds to the internal pressure of the gas comprised in said pressurized gas tank and in that said second separator comprises a second internal pressure which corresponds to atmospheric pressure.

Preferably, the first and second separators are in fluid communication with one another to allow liquid to pass from the first separator to the second separator.

Even more preferably, the device comprises a first air intake device ensuring the passage of air at atmospheric pressure between said at least one first chamber and said second separator, as well as a second air intake device at atmospheric pressure between said at least one second chamber and said second separator.

In addition, the device comprises a third air intake device for the passage of compressed air between said first chamber and said first separator, and a fourth air intake device for the passage of compressed air between said second chamber and said first separator.

Even more preferably, the device comprises a first low-flow control valve for the passage of fluids from said first separator to said first chamber, and a second low-flow control valve for the passage of fluids from said first separator to said second chamber.

According to an advantageous embodiment, the device comprises a regulating valve set at a safety pressure between said first chamber and said first separator and/or between said second chamber and said first separator, to enable the discharge of a volume of liquid from said at least one first or second liquid piston to the first separator.

In addition, each of the first and second chambers is preferably also fluidly connected to a fluid/fluid exchanger which enables said at least one first and second liquid pistons, respectively, to be maintained at ambient temperature, preferably with a tolerated temperature variation of plus or minus 10° C., said fluid/fluid exchanger preferably comprising a pump, a fluid/air exchanger or a fluid/fluid exchanger, optionally a motorized fan if said exchanger is a fluid/air exchanger and optionally at least one control valve.

Advantageously, the insert comprises a core of structural material comprising an expanded honeycomb structure.

More advantageously still, said mechanical actuator comprises a magnetically-actuated linear motor.

In one embodiment, said mechanical actuator comprises a motor associated with a crankshaft.

In yet another variant, said mechanical actuator comprises a motor associated with a worm screw.

The invention also relates to an installation comprising at least two devices as hereinbefore defined, said mechanical actuators of said at least two devices being mechanically linked to operate together, and in that the installation comprises a first phase separator common to said at least two devices, said common first phase separator being connected to a first outlet of the first chambers of the devices and to a second outlet of the second chambers of said devices, said first phase separator being connected to a common pressurized gas storage tank.

In an embodiment where the installation includes at least two devices comprising two phase separators, the second separator being common to said at least two devices, said second separator is connected to said first and second outlets of said first and second chambers of each of said at least two devices, said common first separator comprises a first internal pressure which corresponds to the internal pressure of the gas comprised in said common pressurized gas tank and said second separator comprises a second internal pressure which corresponds to atmospheric pressure.

Finally, the invention relates to a method for implementing a device as defined above, the method comprising the following steps:

actuating the mechanical actuator, moving said at least one solid piston causing the movement of said first liquid piston in said first chamber and said second liquid piston in said second chamber, said first and second liquid pistons being moved in opposite directions, the first liquid piston compressing said gas in the insert of said first chamber to a first predetermined pressure, the second liquid piston creating a vacuum in said insert of said second chamber to a second pressure, when said first pressure is reached, opening an air intake device between said first chamber and said first phase separator to evacuate pressurized gas from the first chamber to said first separator until said liquid piston passes entirely through said insert and reaches the first outlet of the first chamber and simultaneously the air intake in said second chamber.

The device according to the invention is thus a kind of reversible gas compressor, which can compress a gas while consuming mechanical energy, but can also restore mechanical energy by expanding a gas. The thermodynamic evolution of the gas is quasi-isothermal, enabling these pressure variations to be achieved with low energy loss thanks to liquid piston compression/expansion. The nature of the gas and liquid can be adapted to the needs of the application for which the device is intended (air, hydrogen, methane, gas, water, etc.).

In compression mode, within the context of a non-limiting embodiment that will be presented below, the principle is based on gas compression by a liquid piston, the latter being moved by a solid piston. The solid piston is driven directly by a linear motor, of which it is the moving part containing the magnets, or by another piston movement system (connecting rod, crank, rack, etc.). As it moves, the solid piston pushes a liquid piston into a closed compression chamber (vertical cylinder). The decrease in volume results in gas compression.

The cylindrical compression chambers are subdivided into numerous small volumes by a heat exchange insert consisting of an extruded 2D pattern, the cells of which extend in the direction of the liquid piston (also known as a "honeycomb" structure, made of aluminum or other heat-conducting material).

The fluid characteristics of the liquid piston enable a small liquid piston to be formed in each honeycomb cell, guaranteeing a perfect seal between the liquid and gaseous media. The presence of the insert (honeycomb) provides a very large contact surface with the gas, and offers significant heat exchange potential. The heat exchange between the gas and the insert, the heat transfer within the insert, and the insert's own thermal capacity, ensure that the temperature of the gas during compression remains close to the initial temperature of the assembly (quasi-isothermal).

The heat exchange insert thus acts as a regenerative exchanger, successively transferring thermal energy from the gas to the insert by convection/conduction, storing the thermal energy thanks to a moderate increase in its temperature (effect of its thermal capacity) and then transferring this thermal energy to the liquid by convection/conduction.

BRIEF DESCRIPTION OF THE DRAWINGS

Other benefits and features of the invention will become evident upon examining the detailed description of an entirely non-limiting implementation, and from the enclosed drawings wherein.

DETAILED DESCRIPTION

Figure 1:
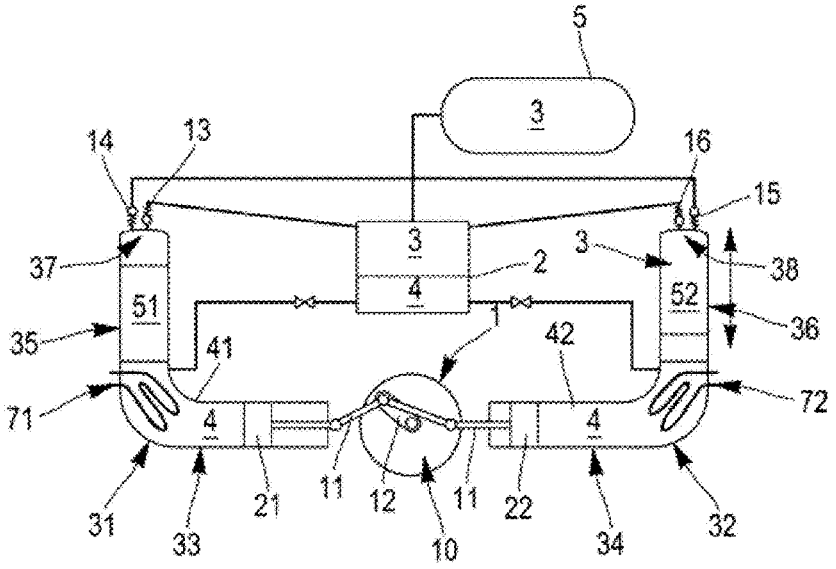
FIG. 1 is a schematic depiction of a first embodiment of a device according to the invention, seen from the side.

FIG. 1 shows an embodiment of a device conforming to the invention, for expanding and compressing a gas, enabling mechanical energy to be stored and restored.

The device thus comprises a mechanical actuator 1, which includes, for example, a crankshaft 10 (a mechanical member that converts reciprocating linear motion into continuous rotation according to the connecting rod 11/crank 12 system, and converts continuous rotary motion into reciprocating linear motion).

A motor, not shown, converts the source energy. Generally, the energy source is electricity. However, an alternative source of rotational drive power could be considered.

It should be noted that the system does not require a "starter" to initiate rotation: for example, in energy release mode (expansion), the crankshaft is rotated directly by the compression/expansion chambers, without assistance from the electric motor/generator.

Crank 12 is connected to two solid pistons 21 and 22, each mounted for movement in a first chamber 31 and a second chamber 32 respectively.

Each chamber 31 and 32 has a liquid piston 41 and 42, respectively, which is moved in the chamber by being pushed by the solid piston 21 and 22 which moves in the same chamber.

Each of the first and second chambers 31 and 32 are made of bent tubes, featuring:

a first tube portion 33 and 34, respectively, extending in a substantially horizontal direction, and a second tube portion 35 and 36, respectively, extending in a substantially vertical direction.

It should be understood that the invention is not limited to the use of angled chambers (in other words, they could have a different shape without going beyond the scope of the invention).

The two solid pistons 21 and 22 are movable in the first tube portions 33 and 34, respectively, being driven in movement by actuator 1.

The two liquid pistons 41 and 42 are movable in the first (33, 34) and second (35, 36) tube portions of chambers 31 and 32, when pushed or sucked by the movement of the associated solid piston 21 or 22.

The second tube portions 35 and 36 are designed to receive and discharge a gas 3, for example air, so that movement of the liquid 4 from the liquid pistons 41 or 42 into the chambers 31 and 32 causes either compression of the gas 3 or expansion of the gas 3.

For this purpose, each of the chambers 31 and 32 comprises an outlet opening 37 and 38, respectively, ensuring in particular the entry and exit of gas into the second tube portions 35 and 36 of the first and second chambers 31 and 32.

The first and second outlets 37 and 38 are connected to a phase separator 2, which accommodates gas 3 and possibly some liquid 4 from the liquid discharged from chambers 1 and 2.

The phase separator 2 is connected to a pressurized gas storage tank 5.

The flow of gas 3 and possibly liquid 4 between phase separator 2, chambers 31 and 32 and the storage tank will be explained later.

The second tube sections 35 and 36 each accommodate an insert 51 and 52.

Inserts 51 and 52 are apertured inserts, that is, they each have cells in which the liquid from liquid pistons 41 and 42 can flow, and which can also accommodate the compressed or expanded gas in chambers 31 and 32.

Inserts 51 and 52 are special in that they are made from a core of expandable sandwich material, giving an insert in which the cells extend right through the insert:

The core of the insert's expandable sandwich material is made up of a multitude of layers of plastically deformable materials, joined together by bonding points (welds, glue, etc.) that extend along lines running the length of the layers. By moving the two outer layers of the sandwich structure away from one another, cells are created between two adjoining layers of material and the connecting lines, resulting in cells that extend along the entire length of the multi-layer structure.

In an alternative embodiment (not shown), the inserts could be made by winding stacked metal sheets, the stacked metal sheets comprising, for example, a flat sheet and a corrugated sheet (forming a succession of hollows and bumps) positioned one on top of the other and rolled together. The cells are then formed between the hollows of the corrugated sheet and the surface of the adjacent sheet, the cells then extending in the direction of movement of the liquid piston in the chamber accommodating the insert.

Figure 6:
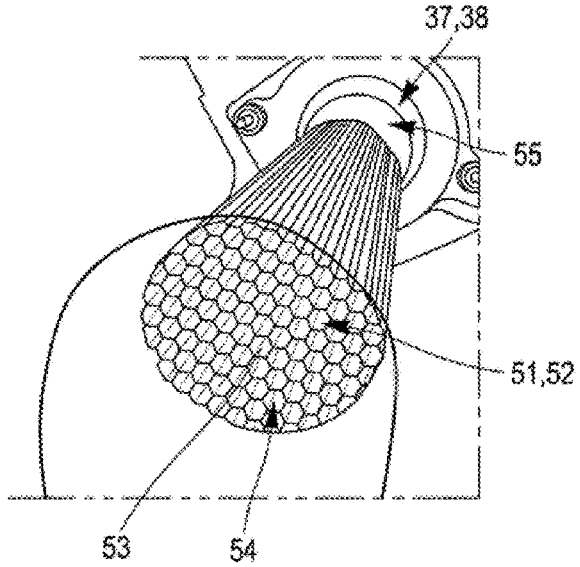
FIG. 6 is an example of an insert with a honeycomb structure, deployed, positioned in a chamber of a device according to the invention, the insert in the chamber being seen from below.

Thus, the insert used in the invention features so-called "through-cells", that is, the cells each have two openings, each at one cell end, with a first cell opening leading to one end of the insert and a second opening leading to another end of the insert. FIG. 6 shows the second tube portion 35 (or 36) of a chamber 31 (or 32) which has been cut away to better show the insert 51 or 52.

Each of the inserts 51 or 52 is preferably made of aluminum and has contiguous cells 53 which together form a honeycomb pattern, and which include a first end opening 54 (visible in the figure), through which gas 3 or liquid 4 can enter or exit the insert. A further opening (not shown in the figure, but shown schematically by an arrow 55) opens close to the outlet opening 37 and 38 of each of the chambers 31 and 32.

Each cell 53 of the insert structure 51 or 52 forms a mini-tube wherein gas 3 and liquid 4 can enter and exit, each mini-tube being oriented parallel or mainly parallel to the direction of movement of liquid 4 and gas 3 in chamber 31 or 32 (more precisely, each mini-tube has an axis parallel to that of the second tube portion 35 or 36 which accommodates it).

"Mainly parallel" refers to the geometric orientation of a cell's entry and exit points with respect to the axis of the insert. This orientation is either parallel or substantially parallel to the axis of the insert, or inclined with respect to the axis of the insert due to the shape of the cell's mini-tube. Indeed, the cell can be straight, in which case the mini-tube is cylindrical, or it can be twisted, in which case the mini-tube forms a helix.

FIG. 1 also shows two fluid/fluid exchangers 71 and 72: each of the first and second chambers 31 and 32 has a fluid/fluid exchanger 71 and 72, respectively (shown in the bend of chambers 31 and 32 in the figure). The fluids are preferably water.

In this example, these fluid/fluid exchangers 71 and 72 are each connected to a pump 83, a fluid/air exchanger 84, a motorized fan 85 and control valves 86. The assembly ensures that liquid 4 (from the liquid pistons) is maintained at a temperature close to ambient temperature, plus or minus 10 degrees Celsius.

A single pump could be provided, without departing from the scope of the invention.

Similarly, the fluid/air exchanger 84 could be replaced by a fluid/fluid exchanger.

The pump 83, the fluid/air exchanger 84, the motorized fan 85 and the control valves 86 are not shown in FIG. 1. However, they can be found in the embodiment shown in FIG. 3. These elements maintain the fluid in the cooling loop at a temperature close to ambient, plus or minus 5 degrees Celsius.

The operating mode of the device shown in FIG. 1 is now presented:

The motor of the mechanical actuator is, for example, a synchronous rotary motor with permanent magnets, and may be associated with a reversible speed reducer (target speed 30 rpm).

Such a motor allows the crankshaft 10 to rotate: the connecting rods 11 that connect the crankshaft crank to each solid piston 21 and 22 drive the solid pistons 21 and 22 in linear motion in an alternating fashion: when piston 21 is pulled, piston 22 is pushed, and vice versa.

The principle of operation in compression mode is as follows: the solid piston 21 pushes the liquid piston 41 into the closed chamber 31. The decrease in gas volume, pushed by the liquid piston 41 into the insert 51, increases the gas pressure in the insert 51.

Each cell 53 acts like a small liquid piston, guaranteeing a perfect seal between the liquid and gaseous media. The insert 51 functions as a regenerative exchanger between the gas and the liquid piston fluid. The presence of the insert 51 offers a large contact surface with the gas 3 and provides a high heat exchange potential. The heat exchange between the gas and the insert, the heat transfer within the insert and its own thermal capacity, enable the temperature of the gas during compression to be maintained at a value close to the initial temperature of the assembly. This is how the operation is considered to be quasi-isothermal.

When the air pressure reaches the desired value, a non-return valve 13 opens, allowing the compressed gas 3 to be released from chamber 31.

The liquid piston 41 continues its ascent in chamber 31 until it touches an end wall of the chamber to release all the compressed gas 3.

The solid motor piston, which has reached the end of its stroke, changes direction and the same procedure is repeated on the second piston 22 of the device made up of exactly the same components. The descent of the liquid piston 41 after the end of compression in the first chamber 31 allows low-pressure gas 3 to enter this chamber 31 through the opening of another valve 14 (non-return valve).

Concerning the thermal energy captured in the gas by insert 51 (the honeycomb structure) during compression, this energy caused the temperature of insert 51 to rise by a few degrees Celsius, reflecting the storage of this thermal energy in the material.

As the liquid piston 41 rises, filling the entire volume of chamber 31 at the end of compression, the thermal insert 51, charged with thermal energy, comes into contact with the liquid 4.

As the solid/liquid heat transfer between insert 51 and the liquid 4 of liquid piston 41 is much more powerful than the solid/gas heat transfer between insert 51 and gas 3, a significant heat exchange occurs between the walls and liquid 4, causing the insert 51-liquid 3 assembly to tend towards a slightly higher equilibrium temperature (of the order of a tenth of a degree above the initial temperature of the liquid), and therefore lower than the temperature of insert 51 prior to contact with liquid 4.

When a new volume of gas 3 to be compressed is admitted, the liquid 4 forming the descending liquid piston 41 passes through the fluid/fluid heat exchanger 71, whose role is to keep the temperature of the liquid piston 41 stable over time.

At the outlet of chamber 31, the compressed gas 3 passes through the gas/liquid separator 2, possibly enabling a fraction of the liquid 4 making up the liquid piston to be collected if the top dead center of chamber 31 is exceeded.

At the outlet of this separator 2, the gas 3 is conveyed to its storage or to another gas compression stage in the storage tank 5.

The liquid 4 retained in the separator helps build up a reserve of liquid for pistons 41 and 42, a fraction of which can be redirected to compression chambers 31 and 32 in order to maintain a volume of liquid capable of guaranteeing continuous system operation.

Valves 13 and 16 are connected between the gas/liquid separator 2 (whose internal pressure is equal to the gas compression pressure) and the base of the compression chamber 31 (whose pressure varies between inlet pressure and maximum pressure). Valves 13 and 16 are used to transfer compressed gas between the compression chambers and the separator, where the gas may include a fraction of the liquid piston fluid.

Note that the outlet 38 of chamber 32 also features two non-return valves 15 and 16, valve 15 ensuring an air supply at atmospheric (or low) pressure.

Non-return valves 13, 14, 15 and 16 can be replaced by pilot-operated valves.

Reference will now be made to the principle of operation in expansion mode of the gas 3.

Figure 2:
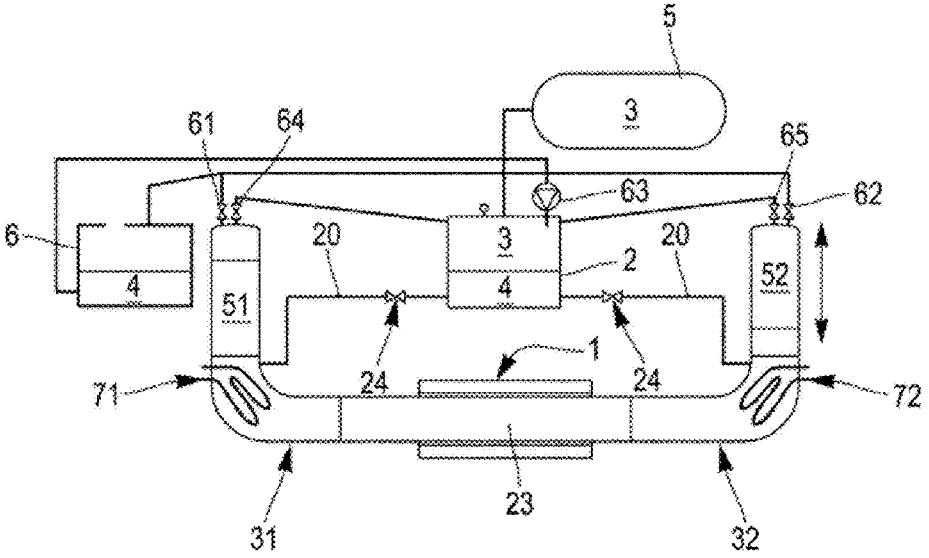
FIG. 2 is a schematic depiction of a second embodiment of a device according to the invention, seen from the side.

The reverse operation of the device, that is, converting pressure energy to electrical energy, works on the same general principle and is possible with the embodiment shown in FIG. 2, by replacing the valves 13 to 16 with pilot-operated valves 64, 61, 62 and 65.

The compression chamber 32, initially full of liquid, admits a volume of pressurized gas 3 through valve 65.

The pressure applied to the liquid piston 42 is applied to the solid piston 22, generating mechanical work.

This mechanical work is converted into electricity by the crankshaft/generator assembly.

When the volume of pressurized gas 3 admitted is sufficient, valve 65 closes and the expansion of gas 3 continues to move solid piston 22.

Movement (and energy conversion) stops when the gas 3 reaches a pressure close to low pressure (usually atmospheric). During the intake and expansion phases, the opposite liquid piston 41 is moved from its low to its high point, expelling the expanded gas 3 at atmospheric pressure outwards through valve 61.

Chamber 32 is thus an expansion chamber, and heat exchange insert 52 is cooled by gas 3 during expansion, while maintaining the expansion of gas 3 in a quasi-isothermal evolution.

The liquid/liquid exchanger 12 then heats the liquid piston 42.

The embodiment shown in FIG. 2 features a second phase separator 6 at atmospheric pressure, which enables any liquid fraction 4 coming from the liquid piston 41 or 42 to be collected at low pressure when the liquid piston 42 (or 41, when the liquid piston 42 acts by compressing the gas 3) is lowered.

In the embodiment shown in FIG. 2, the mechanical actuator comprises a single solid piston 23 which moves either in one direction in chamber 31 or in the opposite direction in chamber 32.

This is a magnetic piston for a linear motor.

The operating mode is the same as that described for the device shown in FIG. 1.

The difference lies in the presence of this second, low-pressure phase separator 6.

As we have already seen, the role of phase separators 2 and 6 is to recover the liquid 4 expelled at the end of the stroke of liquid piston 41 or 42, while allowing gas 3 to continue on its way.

The volume of separators 2 and 6 is chosen so that the speed of gas 3 decreases sufficiently for liquid 4 to fall naturally to the bottom of the buffer volume.

Other complementary solutions may be considered, such as the use of cyclonic systems or coalescence grids. The gas pressure drop in this element must be kept low.

A hydraulic connection 20 between the phase separator 2 and the bottom of the compression chambers 31 and 32 (this may be in the second vertical tube portion 35 and 36, or in the first horizontal tube portion 33 and 34), enables a small flow of liquid 4 to be continuously admitted to compensate for entrainment losses during flushing.

A flow control valve 24 is fitted to each hydraulic link, allowing the flow rate to be varied in order to experimentally find the optimum setting.

Each liquid piston 41 and 42 has a valve 61 and 62 (respectively) for releasing liquid 4 to the non-pressurized second separator 6 in the event of overpressure in chamber 31 and/or 32.

A lift pump 63 between the two separators 2 and 6 returns to the pressurized separator 2 the liquid 4 lost in expansion mode in the non-pressurized separator 6 when gas 3 is released at atmospheric pressure.

Two further valves 64 and 65 transfer compressed gas between the compression chambers 31 and 32 and the separator 2, which may include a fraction of fluid of the liquid piston.

If liquid buffer volume 4 is sufficient, pump 63 operates intermittently and infrequently. This pump is regulated on the basis of the liquid levels in the two separators 2 and 6.

Figure 3:
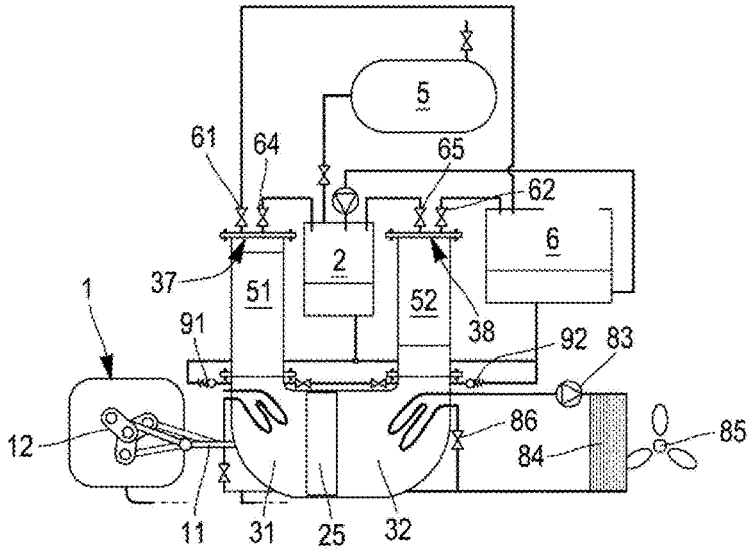
FIG. 3 is another schematic depiction of a third embodiment of a device according to the invention, seen from the side.

The embodiment shown in FIG. 3 concerns the use of a device comprising three solid pistons and six liquid pistons, the "double-acting" piston principle optimizing the use of mechanical parts.

In fact, it is possible to achieve high power levels (tens or hundreds of MW) by multiplying the number of pistons. It may also be possible to increase power by disproportionately increasing piston and chamber diameters, but multiplying the number of pistons and chambers will be preferred. On the one hand, there is an optimum size device that is easy to transport (piston diameter between 300 mm and 2,000 mm, for example, for high-power versions). On the other hand, multiplying the number of pistons reduces the amplitude of variation of the power exchanged with the network if a judiciously established phase shift exists between the sets of two pistons.

Increasing the system's outlet pressure can also be achieved by staggering compressions, using a cascade of compressors as described below.

In the case of stages with inlet pressure above atmospheric pressure (for high-pressure compression), the design of the piston translation system can advantageously make use of 1-to-1 coupling, in opposition to the pistons. In effect, the high-pressure intake force in one chamber is counterbalanced by the higher-pressure compression force in the opposite chamber.

More specifically, double-acting operation offers the following advantages: the high-pressure intake force in one chamber is directly re-employed in the higher-pressure compression force in the opposite chamber, without passing through mechanical power components such as the connecting rod, crankshaft or motor/generator.

Generally speaking, whether single-acting or double-acting, the multiplication of the number of solid pistons secured to the same crankshaft, but cleverly out of phase, helps to limit torque and power variations during system operation. By limiting these variations, the stresses on the components can be kept to a minimum, increasing the reliability of the assembly and limiting the need for over-dimensioning.

The mechanical actuator 1 of the device shown in FIG. 3 thus comprises three pistons, only one of which (piston 25) is shown (the pistons are out of phase by 120°) on the mechanical actuator.

This embodiment achieves a higher pressure than the embodiments shown in FIGS. 1 and 2.

In this embodiment, three successive compression or expansion stages are implemented, with each compression chamber corresponding to a compression stage to be reached. For example, the first chamber has a compression stage of 11 bar, the second chamber has a stage that can increase compression from 11 bar to 70 bar, and the third chamber can increase compression from 70 bar to 300 bar.

It is also possible to allow two of these chambers to form medium-pressure and high-pressure stages.

The embodiment shown in FIG. 3 includes in particular a first control valve 91 set to a safety pressure between said first chamber 31 and said first separator 2, and a second control valve 92 set to a safety pressure between said second chamber 32 and said first separator 2, to enable a volume of liquid to be discharged from said at least one first or second liquid piston to the first separator 2.

Figure 4:
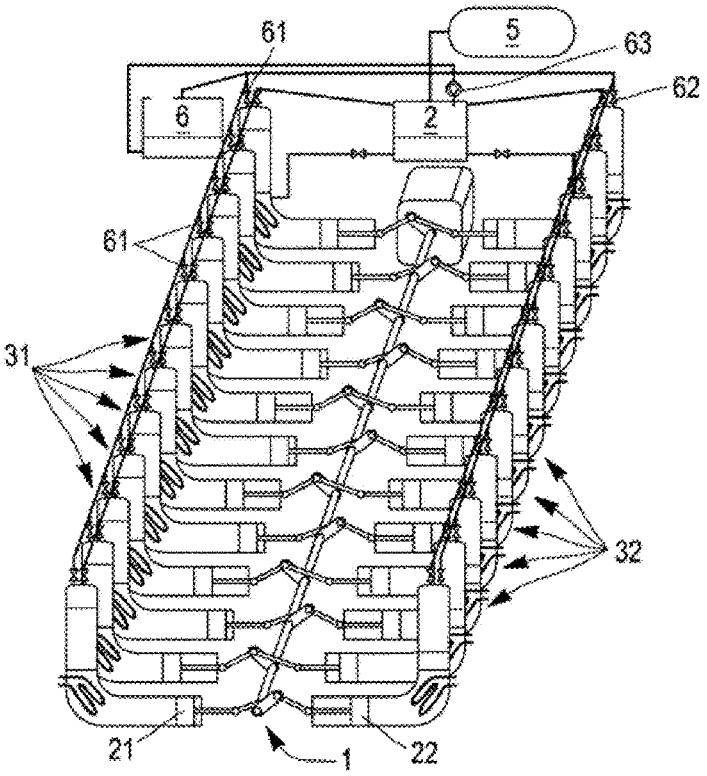
FIG. 4 shows a perspective view of an exemplary embodiment of an installation according to the invention, implementing several devices conforming to the invention.

FIG. 4 shows an installation according to the invention, comprising a series of devices according to the invention.

A common crankshaft-type mechanical actuator drives twelve pairs of solid pistons 21 and 22, movable in twelve pairs of chambers 31, 32, through the movements of cranks 12 mounted on a shaft rotatable about its axis, the cranks being connected to the solid pistons 21 and 22 by connecting rods 11.

Note that all outlet openings 37 and 38 of chambers 31 and 38 are connected together to a first phase separator 2 and a second phase separator 6 at atmospheric pressure: in other words, the pressurized phase separator 2 is connected:

- to the valves 64 of chambers 31, all valves 64 being connected to the same discharge pipe, and
- to valves 65 of chambers 32, all valves 65 being connected to another common discharge pipe.

In addition, all valves 61 of chambers 31 are connected to another common discharge pipe, connected to the second separator, and all valves 62 of chambers 32 are also connected to another common discharge pipe, which is connected to the second separator 6 at atmospheric pressure.

Note that valves 61 and 62 are low-pressure (or atmospheric pressure) air intake valves in FIGS. 2, 3 and 4. They have the same function as the valves 14 and 15 shown in FIG. 1.

In this exemplary embodiment, the solid pistons 21 and 22 have a diameter of 2.5 m and a stroke of 1 m.

Discharge pressure is substantially 11 bar, inlet pressure 1 bar, compression time 1 second. A motor is used to operate the mechanical actuator. However, in addition, two motor/pump assemblies, with smaller power ratings than the main motor, are required to operate the cooling circuit (pump 83) and to transfer liquid 4 from separator 6 to separator 3 (pump 63). Shaft speed is substantially 30 rpm.

The total footprint of such an installation is around 7 m high, 8 m wide and 45 m long.

An average power of 15 MW is achieved with a variation amplitude of less than 0.8 MW at a frequency of 12 Hz.

The ramp-up time to full speed is of the order of a second (from 10% to 100% of rated power).

A start-up time (from total stop to 100% of rated power) of around ten seconds is expected.

Once started, the system's power can be easily adjusted by modifying the motor/generator (and therefore crankshaft) rotation speed, or by adjusting the control of valves 61, 62, 64 and 65. In this way, a range of variation between 20% and 100% of rated power can be exploited, with a fast response time (of the order of a second).

Figure 5:
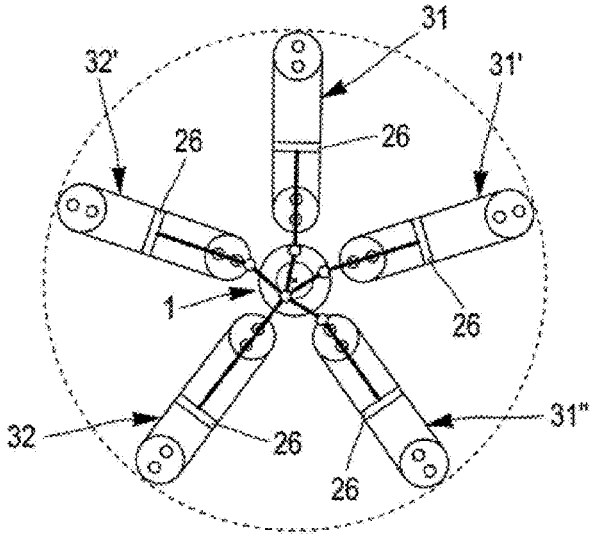
FIG. 5 is a further schematic depiction of a fourth embodiment of a device according to the invention, seen from above.

FIG. 5 shows yet another embodiment, with five chambers 31, 31', 31", 32, 32'arranged in a star-shaped architecture, associated with double-acting pistons 26: The use of double-acting cylinders/pistons 26 not only increases power output for the same number of pistons, but also improves management of liquid leakage through the piston rings. Liquid passing through the piston seals simply flows into the opposite chamber, with no need to drain the leaked liquid.

It is clear from the above description how the invention enables mechanical motion to be transformed into gas pressurization energy, and how this energy can be used to generate mechanical motion.

It should be understood that the invention is not limited to the implementation of the examples specifically described and shown in the figures above and extends to the implementation of any equivalent means.

In particular, the application of the method is not specific to air gas and water fluid. Other applications are envisaged by the invention, such as the compression/expansion of (H2, CO2, CH4, etc.) with water as the liquid piston fluid, but also ionic liquids, solvents, oils, organic liquids, etc.)

The invention claimed is:

1. A device for the isothermal expansion and compression of a gas, ensuring the compression of said gas by consuming mechanical energy and the restitution of mechanical energy by the expansion of said gas, said device comprising:

at least one first and at least one second liquid piston, movable respectively in an at least one first and at least one second chamber, each of said at least one first and second chambers comprising a gas, able to be compressed or expanded under the effect of the movement of said at least one first or second liquid piston;

an actuator capable of moving said at least one first and second liquid pistons in said first and second chambers;

each of said at least one first and second chambers comprising respectively at least one first and at least one second apertured insert through which said liquid and said gas can flow;

said actuator is a mechanical actuator comprising at least one solid piston;

each of said at least one first and second apertured inserts comprise through-cells, which extend between a first cell opening which opens out at one end of said insert and a second cell opening which opens out at a second end of said at least one first and second apertured insert, said through-cells being oriented in a direction which is either parallel to the direction of movement of said at least one first and second liquid piston in said insert or inclined with respect to the direction of movement of said at least one first and second liquid piston;

and said device further comprises at least a first phase separator connected to a first outlet of said at least one first chamber and to a second outlet of said at least one second chamber.

2. The device according to claim 1, wherein said first phase separator is connected to a pressurized gas storage tank.

3. The device according to claim 2, further comprising a second separator, connected to said first and second outlets of said at least one first and second chambers, respectively, in that said first phase separator comprises a first internal pressure which corresponds to the internal pressure of the gas comprised in said pressurized gas storage tank and in that said second separator comprises a second internal pressure which corresponds to atmospheric pressure.

4. The device according to claim 3, wherein said first and second separators are in fluid communication with one another to allow liquid to pass from the first separator to the second separator.

5. The device according to claim 3, further comprising a first air intake device ensuring the passage of air at atmospheric pressure between said at least one first chamber and said second separator and a second air intake device at atmospheric pressure between said at least one second chamber and said second separator.

6. The device according to claim 3, further comprising a third air intake device ensuring the passage of compressed air between said at least one first chamber and said first separator and a fourth compressed air intake device between said at least one second chamber and said first separator.

7. The device according to claim 3, further comprising a first low-flow control valve ensuring the passage of fluids from said first separator to said at least one first chamber and a second low-flow control valve ensuring the passage of fluids from said first separator to said at least one second chamber.

8. The device according to claim 3, further comprising a regulating valve set at a safety pressure between said at least one first chamber and said first separator and/or between said at least one second chamber and said first separator, to enable a volume of liquid to be discharged from said at least one first or second liquid piston to the first separator.

9. The device according to claim 1, wherein each of the at least one first and second chambers is fluidly connected to a fluid/fluid exchanger which makes it possible to maintain said at least first and second liquid pistons, respectively, at ambient temperature, with a tolerated temperature variation of plus or minus 10° C., said fluid/fluid exchanger comprising a pump, a fluid/air exchanger, optionally a motorized fan if said exchanger is a fluid/air exchanger and optionally at least one control valve.

10. The device according to claim 1, wherein each of said at least one first and second insert comprises a core of structural material comprising an expanded honeycomb structure.

11. The device according to claim 1, wherein said mechanical actuator comprises a magnetically actuated linear motor.

12. The device according to claim 1, wherein said mechanical actuator comprises a motor associated with a crankshaft.

13. The device according to claim 1, wherein said mechanical actuator comprises a motor associated with a worm screw.

14. An installation comprising at least two devices according to claim 1, wherein each of said mechanical actuators of said at least two devices are mechanically linked to operate together, said first phase separator is common to said at least two devices, and said first phase separator is connected to a common pressurized gas storage tank.

15. The installation according to claim 14, comprising a second separator, connected to said first and second outlets of said first and second chambers, respectively, said first separator comprises a first internal pressure which corresponds to the internal pressure of the gas comprised in said common pressurized gas storage tank and said second separator comprises a second internal pressure which corresponds to atmospheric pressure, wherein said second separator is common to said at least two devices, said common second separator being connected to said first and second outlets of said at least one first and second chambers of each of said at least two devices, in that said first common separator comprises a first internal pressure which corresponds to the internal pressure of the gas comprised in said common pressurized gas tank and in that said common second separator comprises a second internal pressure which corresponds to atmospheric pressure.

16. A method for implementing the device according to claim 1, comprising the following steps:

actuating the mechanical actuator, moving said at least one solid piston causing the movement of said at least one first liquid piston in said at least one first chamber and said at least one second liquid piston in said at least one second chamber, said at least one first and second liquid pistons being moved in opposite directions, the at least one first liquid piston compressing said gas in the at least one apertured insert of said at least one first chamber to a first predetermined pressure, the at least one second liquid piston creating a low pressure in said at least one apertured insert of said at least one second chamber to a second pressure, when said first pressure is reached, opening an air intake device between said at least one first chamber and said first phase separator to discharge pressurized gas from the at least one first chamber to said first separator until said at least one liquid piston passes entirely through said at least one apertured insert and reaches the first outlet of the at least one first chamber, and simultaneously the intake of air into said at least one second chamber.

17. A device for the isothermal expansion and compression of a gas, ensuring the compression of said gas by consuming mechanical energy and the restitution of mechanical energy by the expansion of said gas, said device comprising:

at least one first and at least one second liquid piston, movable respectively in an at least one first and at least one second chamber, each of said at least one first and second chambers comprising a gas, able to be compressed or expanded under the effect of the movement of said at least one first or second liquid piston;

an actuator capable of moving said at least one first and second liquid pistons in said first and second chambers;

each of said at least one first and second chambers comprising respectively at least one first and at least one second apertured insert through which said liquid and said gas can flow;

said actuator is a mechanical actuator comprising at least one solid piston;

each of said at least one first and second apertured inserts comprise through-cells, which extend between a first cell opening which opens out at one end of said insert and a second cell opening which opens out at a second end of said at least one first and second apertured insert, said through-cells being oriented in a direction which is either parallel to the direction of movement of said at least one first and second liquid piston in said insert or inclined with respect to the direction of movement of said at least one first and second liquid piston;

said device further comprises at least a first phase separator connected to a first outlet of said at least one first chamber and to a second outlet of said at least one second chamber; and each of the at least one first and second chambers is fluidly connected to a fluid/fluid exchanger which makes it possible to maintain said at least first and second liquid pistons, respectively, at ambient temperature, with a tolerated temperature variation of plus or minus 10° C., said fluid/fluid exchanger comprising a pump, a fluid/air exchanger, optionally a motorized fan if said exchanger is a fluid/air exchanger and optionally at least one control valve.

18. A device for the isothermal expansion and compression of a gas, ensuring the compression of said gas by consuming mechanical energy and the restitution of mechanical energy by the expansion of said gas, said device comprising:

at least one first and at least one second liquid piston, movable respectively in an at least one first and at least one second chamber, each of said at least one first and second chambers comprising a gas, able to be compressed or expanded under the effect of the movement of said at least one first or second liquid piston;

an actuator capable of moving said at least one first and second liquid pistons in said first and second chambers;

each of said at least one first and second chambers comprising respectively at least one first and at least one second apertured insert through which said liquid and said gas can flow;

said actuator is a mechanical actuator comprising at least one solid piston;

each of said at least one first and second apertured inserts comprise through-cells, which extend between a first cell opening which opens out at one end of said insert and a second cell opening which opens out at a second end of said at least one first and second apertured insert, said through-cells being oriented in a direction which is either parallel to the direction of movement of said at least one first and second liquid piston in said insert or inclined with respect to the direction of movement of said at least one first and second liquid piston;

said device further comprises at least a first phase separator connected to a first outlet of said at least one first chamber and to a second outlet of said at least one second chamber; and each of said mechanical actuators of said at least two devices are mechanically linked to operate together, said first phase separator is common to said at least two devices, and said first phase separator is connected to a common pressurized gas storage tank.

19. The installation according to claim 18, comprising a second separator, connected to said first and second outlets of said first and second chambers, respectively, said first separator comprises a first internal pressure which corresponds to the internal pressure of the gas comprised in said common pressurized gas storage tank and said second separator comprises a second internal pressure which corresponds to atmospheric pressure, wherein said second separator is common to said at least two devices, said common second separator being connected to said first and second outlets of said at least one first and second chambers of each of said at least two devices, in that said first common separator comprises a first internal pressure which corresponds to the internal pressure of the gas comprised in said common pressurized gas tank and in that said common second separator comprises a second internal pressure which corresponds to atmospheric pressure.

* * * * *